US005283409A

United States Patent [19]

Brendel et al.

[11] Patent Number: 5,283,409

[45] Date of Patent: Feb. 1, 1994

[54] COIL BODY FOR THE INDUCTIVE HEATING OF ROLLERS

[75] Inventors: Bernhard Brendel, Grefrath; Werner Borkenhagen, Krefeld; Bernard Funger, Krefeld; Stefan Krebs, Krefeld, all of Fed. Rep. of Germany

[73] Assignee: Eduard Küsters Maschinenfabrik GmbH & CO KG, Krefeld, Fed. Rep. of Germany

[21] Appl. No.: 847,084

[22] Filed: Apr. 13, 1992

[30] Foreign Application Priority Data

Oct. 13, 1989 [DE] Fed. Rep. of Germany ..... 3934208

[51] Int. Cl.[5] ..... H05B 6/42

[52] U.S. Cl. ..... 219/619; 219/652; 336/57

[58] Field of Search ..... 219/10.492, 10.61 A, 219/10.491, 10.79; 336/57, 61

[56] References Cited

U.S. PATENT DOCUMENTS

| | | | |
|---|---|---|---|
| 2,277,223 | 3/1942 | Goodridge | 219/10.491 |
| 2,351,300 | 6/1944 | Somers | 219/13 |
| 3,674,247 | 7/1972 | Gillick | 266/4 E |
| 4,005,302 | 1/1977 | Graf et al. | 219/10.61 |
| 4,247,736 | 1/1981 | Grigoriev et al. | 219/10.491 |
| 4,251,705 | 2/1981 | Balzer | 219/10.79 |
| 4,960,967 | 10/1990 | Buffenoir et al. | 219/10.491 |
| 5,101,086 | 3/1992 | Dion et al. | 219/10.491 |

FOREIGN PATENT DOCUMENTS

| | | |
|---|---|---|
| 0020215 | 12/1980 | European Pat. Off. . |
| 0059421 | 9/1982 | European Pat. Off. . |
| 0196264 | 10/1986 | European Pat. Off. . |
| 1583324 | 8/1970 | Fed. Rep. of Germany . |
| 3438375 | 6/1988 | Fed. Rep. of Germany . |

*Primary Examiner*—Philip H. Leung
*Attorney, Agent, or Firm*—Kenyon & Kenyon

[57] ABSTRACT

An inductive coil for heating a rotating roller is embedded in a plastic carrier. To cool the plastic carrier in the region of the coil, a cooling element in the form of a flat cooling chamber through which a fluid cooling medium can flow is provided on the front surface of the plastic carrier facing the roller periphery.

6 Claims, 1 Drawing Sheet

COIL BODY FOR THE INDUCTIVE HEATING OF ROLLERS

The invention relates to a coil body for the inductive heating of the surface of a rotating roller made of an electrically conductive material.

A coil body used for inductively heating a roller is shown in EP-OS 59 421. The inductive heating of rollers serves to increase the temperature of the roller surface, allowing the pressure treatment of a web material to be carried out at a higher temperature. The roller can be used, for example, in order to be able to calender a paper web at a higher temperature. For this purpose, a whole number of coil bodies of the type in question are arranged side by side, close to one another, along the roller surface. This can raise the temperature level of the roller as a whole. The bodies can be controlled separately, in order to adjust a certain temperature profile. This can be done because the paper web requires a temperature increase at a certain location, or in order to increase the roller diameter and therefore the linear pressure at the point in question by a local temperature increase.

The coil bodies are shown only schematically in EP-OS 59 421. In practice, they consist of a plastic block, the front side of which is geometrically adapted to the periphery of the roller, i.e. is partially cylindrical. Directly below the partially cylindrical front surface, the actual coil is embedded in the plastic block. The coil consists of a stranded conductor with many individual wires, the coil having an approximately rectangular cross-section. The stranded conductor is wound into a spiral, with the coil's narrow edge nearest the roll surface. The spiral extends in a partially cylindrical region in the plastic block. It stands opposite the roller surface at a slight distance, without making contact.

The coil is charged at a medium frequency, for example in the range of 15 to 18 kHz. Because of this relatively high frequency, the coil wire should be structured as a stranded conductor with individual varnish-insulated wires. The coil is connected to an oscillating circuit with a voltage of about 800 volts.

With coils of this type, temperatures at the surface of the rollers, which consist mostly of steel, run in the range of about 160° C. However, recent efforts tend in the direction of increasing the temperature at the surface of the roller to about 250° C.

In order to generate such temperatures, an increase in the output of the induction coil is required. The coil wires embedded in the plastic body undergo a great temperature increase due to inductive effects, on the one hand, and by reflection from the relatively hot roller surface, on the other hand. It has been shown that the conventional coil bodies of the type described above are not able to withstand the output increases desired, and that the front surface of the plastic body bursts off after a certain operating period. In many cases, such a coil body could no longer be used after six hours.

The invention is based on the need for making a coil body as described above suitable for higher working temperatures.

This task is accomplished by the invention as described in the instant specification and claim.

The partially cylindrical, concave front surface of the plastic carrier is adapted to the radial periphery of the roller, and is intended for application directly in front of the roller periphery. The cooling chamber has the effect that the front surface of the plastic carrier can be kept at temperature low enough so that no destruction takes place and the higher temperatures at the roller surface are withstood over extended periods of time. Tests have shown problem-free operation over 42 hours. The fluid cooling medium not only conducts heat away from the region of the front surface of the plastic carrier, but simultaneously holds the radiation proceeding from the roller surface away from this front surface. The heat output to be conducted away is about 100 watts with a commercial coil body of normal size, which can be easily accomplished by a fluid cooling medium, even without large throughput.

Cooling is known in connection with induction coils. DE-C2-34 38 375 shows the use of cooling water flowing through an inductive conductor, where the inductive conductor is used for heating a roller surface. However, in this invention, what is used for cooling is a conductor loop made from a solid copper pipe. The present invention, however, involves a greater output concentration, which makes higher frequencies and greater winding numbers necessary and in which a direct flow through the individual conductor can no longer be achieved.

In U.S. Pat. No. 4,005,302 a "galette" is described. The galette is a rotating heated small drum for stretching yarns, which is inductively heated from the inside. Radially outside the coil which surrounds the bearing journal is a cylindrical cooling chamber through which a cooling medium can flow; this chamber is formed inside the drum.

An important further feature of the invention lies in structuring the limitation surface of the cooling element which faces the roller so as to make it highly heat-reflective. Because of this, the heat flow radiated by the roller is only partially absorbed by the cooling element. The reflection increase of the cooling element can not take place by metallization or application of metallic mirror elements, because these are subject to the induction effect and would also be heated. Rather, it is necessary to bring about the greatest possible reflection capacity, i.e. the highest possible ratio of the amount of incident radiation to reflected radiation, by increasing the degree of whiteness and the polish of the surface.

In the drawings, an embodiment of the invention is shown schematically:

Figure 1:
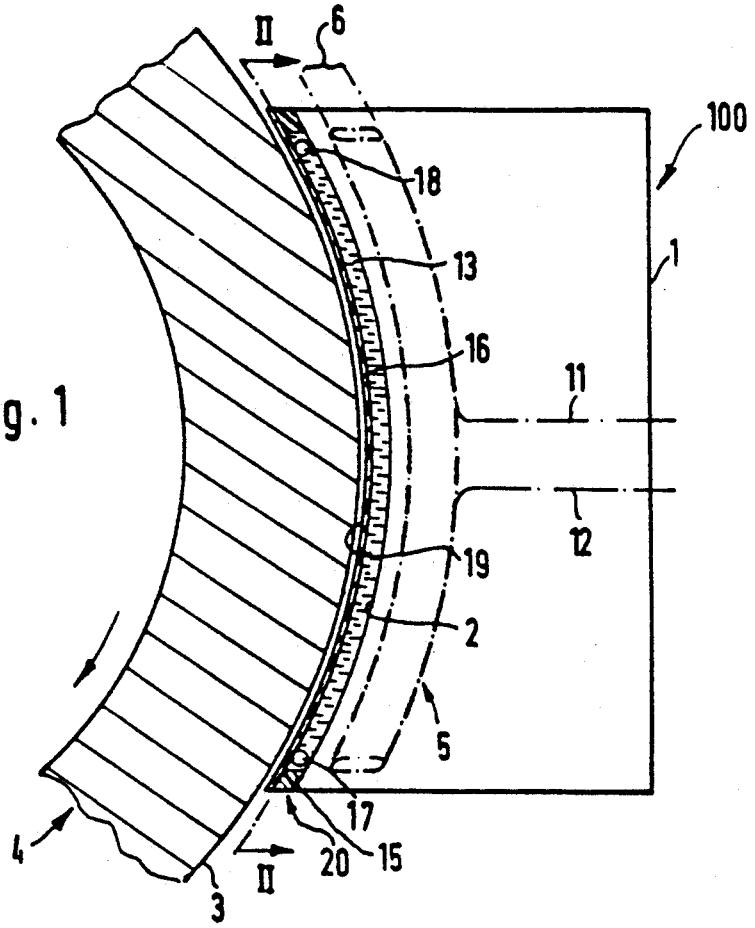
FIG. 1 shows a side view of a coil body arranged at a roller surface, in partial cross-section.

The coil body, designated as 100 in FIG. 1, comprises a plastic carrier 1 in the form of a cuboid block with a partially cylindrical front surface 2, which is adapted to fit the outside periphery 3 of a rotating roller 4, i.e. is coaxially formed with the roller. The rotating roller 4 is represented as a hollow roller made of steel, through which a cross-head (not shown) passes lengthwise. The roller is supported on the inside on the non-rotating cross-head, by means of hydraulic support devices (not shown).

Figure 3:
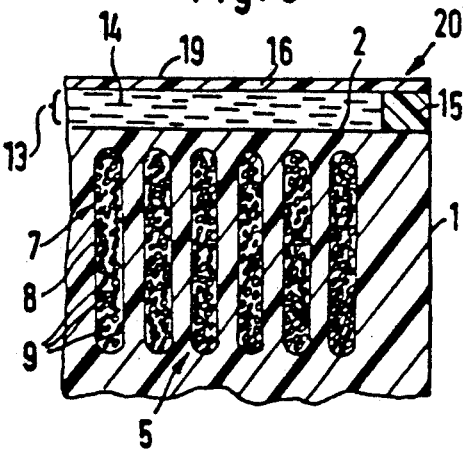
FIG. 3 shows a partial cross-section along the line III—III in FIG. 2.

Directly below the front surface 2 an induction coil 5, of which only the outlines are shown in FIG. 1, is provided: The axis of the coil stands perpendicular to the roller surface, and runs in spiral form in a partially cylindrical region 6. The coil is coaxial to the front surface 2, i.e. to the roller periphery 3. The coil wire is formed by a stranded conductor 8 with very many individual wires 9 which are insulated from one another by varnish. The cross-section of the coil wire 7 is rectangular, where the length of the rectangle consists of a multiple of the width. As is evident from FIG. 3, the coil wire stands on edge, i.e. with the longer rectangle sides perpendicular to the roller periphery 3.

Figure 2:
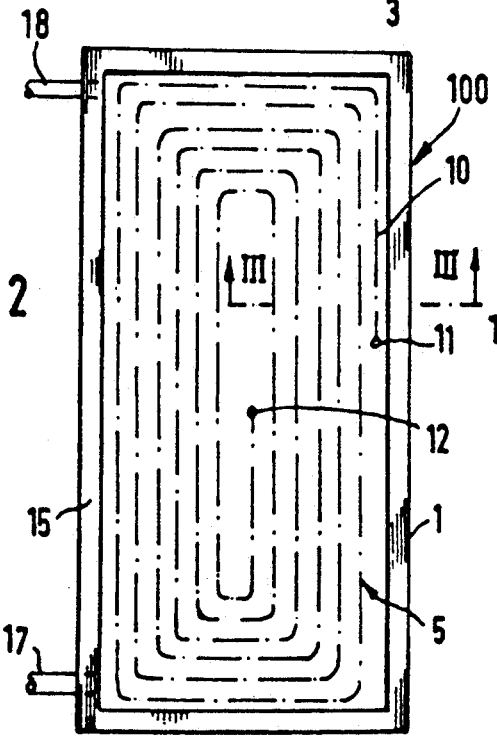
FIG. 2 shows a view according to FIG. 1 from the left along the line II—II in FIG. 1.

The "basic outline" of the coil 5 is evident from FIG. 2 and indicated with the progression of the center line 10 of the coil wire 7. The coil wire 7 runs, with its center line 10, from the incoming line 11 along a rectangular (adapted to the cross-section of the plastic carrier 1) spiral-shaped path from the incoming line 11 to the return line 12 and thus forms a spiral-shaped coil with six windings in the embodiment shown.

The coil 5 is cast into the material of the plastic carrier 1. The front surface 2 of the plastic carrier 1 stands opposite the roller periphery 3 at a slight distance. The region of the plastic carrier 1 which is located in the vicinity of the front surface 2 experiences a significant temperature stress, which results in destruction there, also due to the different materials of the coil 5 and the plastic carrier 1, if particularly great output is demanded.

For this reason, a flat cooling element, designated as a whole as 20, which completely covers the front surface 2, is provided in front of the front surface 2, which element is structured as a cooling chamber 13, through which cooling water 14 flows. The cooling chamber 13 is delimited by a ridge 15 which borders the front surface 2 in closed manner, on which ridge a cover 16 in the form of a thin plastic blade, for example with a thickness of 1 mm, is applied, so that the cooling chamber 13 is closed off, except for the inlet 17 and the outlet 18. Since the circumferential ridge 15 has a uniform height of 3 mm, for example, all the way around, the cover 16 automatically takes a shape adapted to the roller periphery 3, and stands opposite the roller periphery 3 with the least possible distance in operation. The height of the chamber 13 should be as low as possible, so that the coil 5 can be moved as close as possible to the roller periphery 3 in spite of the presence of the cooling element 20, which helps to further the degree of effectiveness of the inductive heating by the coil 5.

The surface of the blade-shaped cover 16 of the cooling chamber 13 which faces the roller periphery 3 is white and polished, in order to reflect the greatest possible proportion of the heat radiated by the roller periphery 3.

We claim:

1. A coil body for inductively heating the surface of a rotating roller made of electrically conductive material, the roller and body being used for the pressure and temperature treatment of webs of paper and similar materials, said coil body comprising:

a plastic carrier comprising a partially cylindrical concave front surface;

a coil embedded in the plastic carrier behind the front surface;

a flat cooling chamber in front of the front surface, said flat cooling chamber covering substantially the front surface, the cooling chamber conducting heat from the front surface, the cooling chamber having connections for conveying a fluid cooling medium into and out of said cooling chamber, said flat cooling chamber being surrounded by a ridge of uniform height which is closed except for the connections for conveying said fluid cooling medium, said cooling chamber being covered by a thin-walled plastic cover sealed to the ridge and coaxial with the front surface.

2. The coil body of claim 1, wherein:

a surface of said thin walled plastic cover adjacent the roller is highly heat-reflective.

3. The coil body of claim 2, wherein: the surface of said thin walled plastic cover adjacent the roller is white and highly polished.

4. An inductive heating apparatus for an electrically conductive roller comprising:

a body constructed of a non-electrically conductive substance;

an electrical coil embedded in said body, said electrical coil acting to inductively heat said roller when said apparatus is adjacent said roller;

a concave cylindrical surface attached to said body, said surface being constructed of a non-electrically conductive substance;

a ridge sealed to said body and to said surface, said body, ridge and surface defining therebetween a cooling chamber; and a passage for conveying cooling fluid into and out of said cooling chamber, wherein said surface is cooled by the conveyance of cooling fluid into and out of said cooling chamber.

5. The inductive heating apparatus of claim 4, wherein:

said surface is highly reflective on its outer periphery.

6. The inductive heating apparatus of claim 4 wherein:

said coil is a spiral coil; and the cooling chamber is interposed between the surface and the coil.

* * * * *